United States Patent [19]

Grondahl

[11] Patent Number: 4,531,889

[45] Date of Patent: Jul. 30, 1985

[54] COOLING SYSTEM UTILIZING FLOW RESISTANCE DEVICES TO DISTRIBUTE LIQUID COOLANT TO AIR FOIL DISTRIBUTION CHANNELS

[75] Inventor: Clayton M. Grondahl, Clifton Park, N.Y.

[73] Assignee: General Electric Co., Schenectady, N.Y.

[21] Appl. No.: 462,768

[22] Filed: Feb. 1, 1983

Related U.S. Application Data

[63] Continuation of Ser. No. 176,600, Aug. 8, 1980, abandoned.

[51] Int. Cl.[3] ..... F01D 5/18

[52] U.S. Cl. ..... 416/96 R; 416/97 R

[58] Field of Search ..... 416/92, 95, 96 A, 96 R, 416/97 R, 97 A; 415/114, 115; 138/42; 251/127

[56] References Cited

U.S. PATENT DOCUMENTS

| | | | |
|---|---|---|---|
| 2,991,973 | 7/1961 | Cole et al. | 416/92 |
| 3,411,764 | 11/1968 | Allen | 416/95 |
| 3,658,439 | 4/1972 | Kydd | 416/97 |
| 3,706,508 | 12/1972 | Moskowitz | 415/115 |
| 3,804,551 | 4/1974 | Moore | 416/97 |
| 4,017,210 | 4/1977 | Darrow | 416/97 R |
| 4,118,145 | 10/1975 | Stahl | 416/97 R |
| 4,212,587 | 7/1980 | Horner | 416/96 R |
| 4,242,045 | 12/1980 | Grondahl | 416/96 R |
| 4,244,676 | 1/1981 | Grondahl | 416/92 |
| 4,267,045 | 5/1981 | Hoof | 138/42 |
| 4,293,275 | 10/1981 | Kobayashi et al. | 416/97 R |
| 4,350,473 | 12/1982 | Dakin | 416/96 R |

FOREIGN PATENT DOCUMENTS

| | | | |
|---|---|---|---|
| 641146 | 8/1950 | United Kingdom | 416/92 |

*Primary Examiner*—Samuel Scott
*Assistant Examiner*—B. Bowman
*Attorney, Agent, or Firm*—J. C. Squillaro

[57] ABSTRACT

An improved cooling system utilizes flow resistant devices distributing liquid coolant to air foil coolant channels in a bucket of a turbine. A separate flow resistance device associated with each of the air foil coolant channels resist the flow of liquid coolant into the coolant channels whereby a fluid head is developed in a standpipe upstream of the flow resistance devices. The fluid head, together with the outward radial acceleration meters the flow of fluid through each flow resistance device according to the head. In the disclosed embodiments, the flow resistant devices alternately take the form of a tortuous passage, an orifice and a plurality of vortex flow chambers.

5 Claims, 10 Drawing Figures

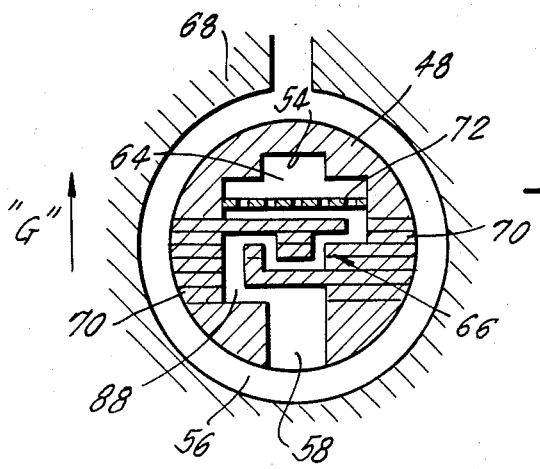
FIG. 5.
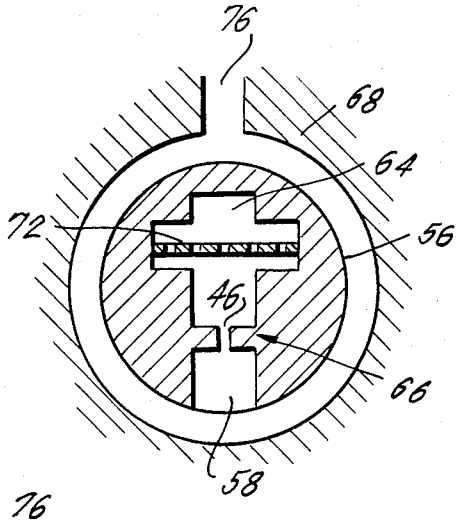
FIG. 6.
FIG. 7.
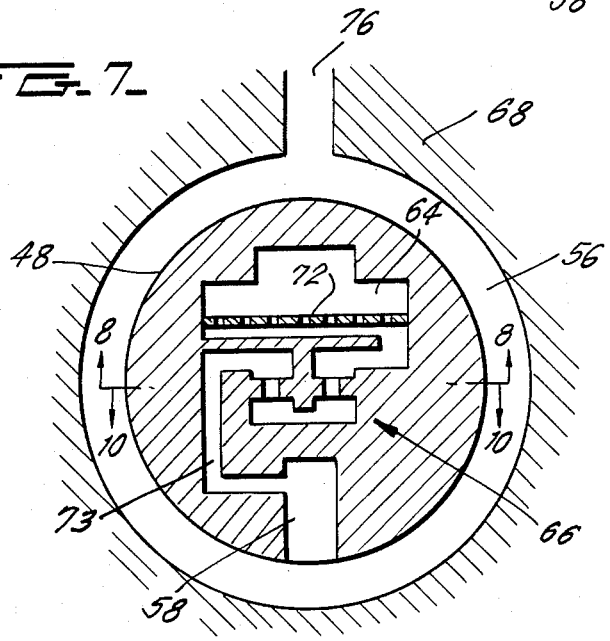

COOLING SYSTEM UTILIZING FLOW RESISTANCE DEVICES TO DISTRIBUTE LIQUID COOLANT TO AIR FOIL DISTRIBUTION CHANNELS

This is a continuation of application Ser. No. 176,600, filed Aug. 8, 1980, now abandoned.

BACKGROUND OF THE INVENTION

The present invention is directed towards an improved cooling system for a gas turbine. More particularly, the present invention is directed towards an improved cooling system which employs flow-resistance devices to meter coolant into a plurality of platform and air foil coolant channels located in the buckets of the gas turbine.

The cooling system of the present invention is utilized in connection with a gas turbine of the type including a turbine disk mounted on a shaft rotatably supported in a casing and a plurality of turbine buckets extending radially outward from the disk. Each of the buckets includes a root portion mounted in the disk, a shank portion extending radially outward from the root portion to a platform portion, and an air foil extending radially outward from the platform portion. During operation, the buckets receive a driving force from hot fluids moving in a direction generally parallel to the axis of the shaft and convert this driving force to rotational motion which is transmitted to the shaft via the turbine disk. As the result of the relatively high temperatures of the hot fluid, a significant amount of heat is transferred to the turbine buckets. In order to remove this heat from the bucket structure, the prior art has developed a large variety of open-liquid cooling systems. Exemplary of such systems are U.S. Pat. No. 3,658,439, issued to Kydd; U.S. Pat. No. 3,804,551, issued to Moore; U.S. Pat. No. 4,017,210, issued to Darrow; and U.S. application Ser. No. 044,660, filed June 1, 1979, in the names of C. M. Grondahl and M. R. Germain, now U.S. Pat. No. 4,244,676. the disclosure of which is incorporated herein by reference.

Open circuit liquid cooling systems are particularly important because they make it feasible to increase the turbine inlet temperature to an operating range of from 2500° F. to at least 3500° F., thereby obtaining an increase in power output ranging from about 100%–200% and an increase in thermal efficiency ranging to as high as 50%. A primary requirement of open circuit liquid cooling systems is that the liquid coolant be evenly distributed to the several platform and air foil coolant channels formed in the bucket. Such a distribution is difficult to obtain as a result of the extremely high bucket tip speeds employed, resulting in centrifugal fields of the order of 25,000 G.

To obtain an even flow of coolant liquid throughout the several coolant channels, the prior art systems, as exemplified by U.S. Pat. Nos. 3,804,551 and 4,017,210, supra, utilize weir structures which meter the amount of coolant liquid supplied to each individual channel from pools of coolant liquid formed in the platform portion of the bucket. Particularly, these systems introduced liquid coolant into each end of a trough formed in the platform portion of the bucket such that liquid coolant flows in a direction parallel to the axis of rotation of the turbine disk from each end of the trough. The liquid coolant flows over the top of an elongated weir which performs the metering for each channel.

In order to perform satisfactorily, it is critical that the tops of these weirs be parallel to the axis of rotation of the turbine within a tolerance of several mils. If this relationship is not maintained, all of the coolant liquid will flow over the low end of the weir and, consequently, some of the coolant channels formed in the platform and air foil of the bucket will be starved for coolant.

In an effort to overcome the foregoing problem, the invention described in U.S. Pat. No. 4,244,676 utilizes V-shaped notched weirs which are less sensitive to variations in the orientation in the metering channels than the prior art weirs. While this invention represents an improvement over the prior art weir structures, all weir metering devices depend upon a uniform depth of water above the crest of each weir to ensure an equal supply of cooling water to the individual bucket cooling channels. While the V-shaped notched weirs make the accuracy of flow metering less sensitive to manufacturing tolerances and in-service distortion, it is still affected by waves on the surface of the water in the reservoir supplying the weirs. Such waves have been found to occur as a result of oscillations in the flow rate of water to the metering device and may also result from rotor vibrations.

BRIEF DESCRIPTION OF THE INVENTION

In order to overcome the foregoing drawbacks of the prior art metering structures, the present invention utilizes resistance flow devices to meter water into each bucket cooling channel. Such devices are not dependent upon a stable, uniform water surface for accurate metering. Thus, while flow through a resistance flow device is typically proportional to the square root of the pressure head (i.e., $H^{\frac{1}{2}}$), weir flow rates are at best about proportional to the pressure head and may be as sensitive as $H^{5/2}$.

In accordance with the foregoing, the liquid coolant distribution system of the present invention includes:

a plurality of shank coolant channels located in the shank portion of a turbine bucket and extending to platform cooling channels located in the platform portion of a turbine bucket that extend into foil cooling channels located in the air foil of the turbine bucket; and metering means for receiving coolant from a source of liquid coolant and for distributing the coolant evenly into each of the platform coolant supply channels, the metering means including a plurality of resistance flow devices.

BRIEF DESCRIPTION OF THE DRAWINGS

For the purpose of illustrating the invention, there are shown in the drawings several forms which are presently preferred, it being understood, however, that this invention is not limited to the precise arrangements and instrumentalities shown.

FIG. 5 is a cross-sectional view taken along line 5—5 of FIG. 4 illustrating a first embodiment of a flow resistance device which may be used in accordance with the principles of the present invention.

FIG. 6 is a cross-sectional view taken along line 5—5 of FIG. 4 illustrating a second flow resistance device which may be used in accordance with the principles of the present invention.

FIG. 7 is a cross-sectional view taken along line 5—5 of FIG. 4 illustrating a third flow resistance device which may be used in accordance with the principles of the present invention.

DETAILED DESCRIPTION OF THE INVENTION

Figure 1:
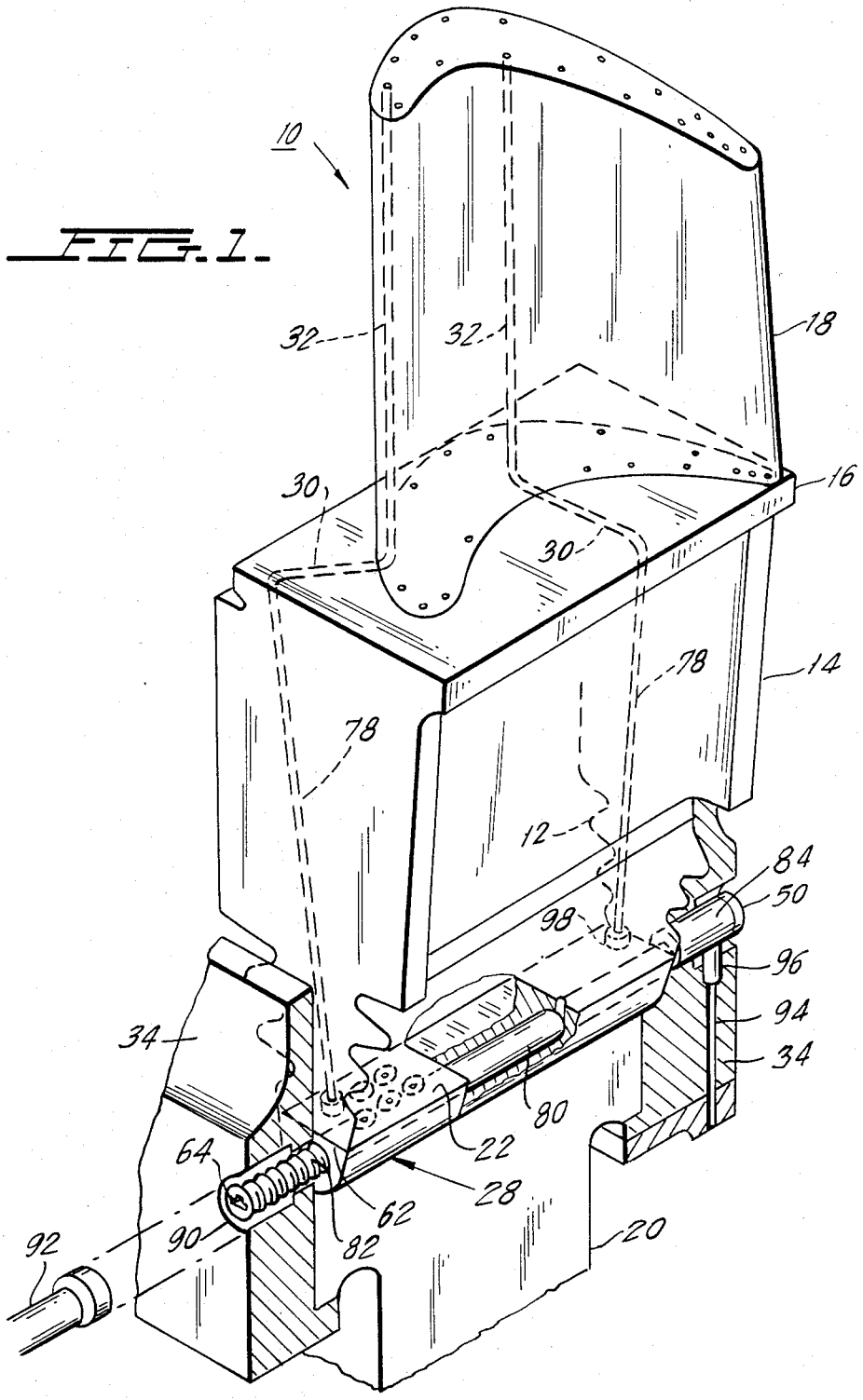
FIG. 1 is a perspective view of a first embodiment of the improved cooling system of the present invention.

Referring now to the drawings, wherein like numerals indicate like elements, there is shown in FIG. 1 a turbine bucket constructed in accordance with the principles of the present invention and designated generally as 10. Bucket 10 includes a root portion 12, a shank portion 14, a platform portion 16 and an air foil 18. Root portion 12 is embedded in a turbine rotor disk 20 which is mounted on a shaft (not shown) rotatably supported in a casing (not shown). As will be recognized by those skilled in the art, an actual turbine will include a plurality of buckets 10 located about the entire periphery of the rotor disk 20.

As noted above, the present invention is directed towards an improved cooling system for use with gas turbines of the general type illustrated in FIG. 1. A water delivery system, such as described in copending patent application Ser. No. 842,407, filed Oct. 17, 1977 by Anderson et al, distributes the coolant to passage 94 and thereby to individual buckets 10. Passage 94 directs the coolant liquid to stand pipe 96, which is integral with distribution channel 28 located beneath the root portion 12 of bucket 10. The structure of distribution channel 28 is illustrated in FIGS. 2–10 and is described in detail below. The coolant liquid supplied by passage 94 collects in stand pipe 96 of distribution channel 28 and is thereafter metered into a plurality of shank coolant channels 78 formed in the shank 14.

Figure 4:
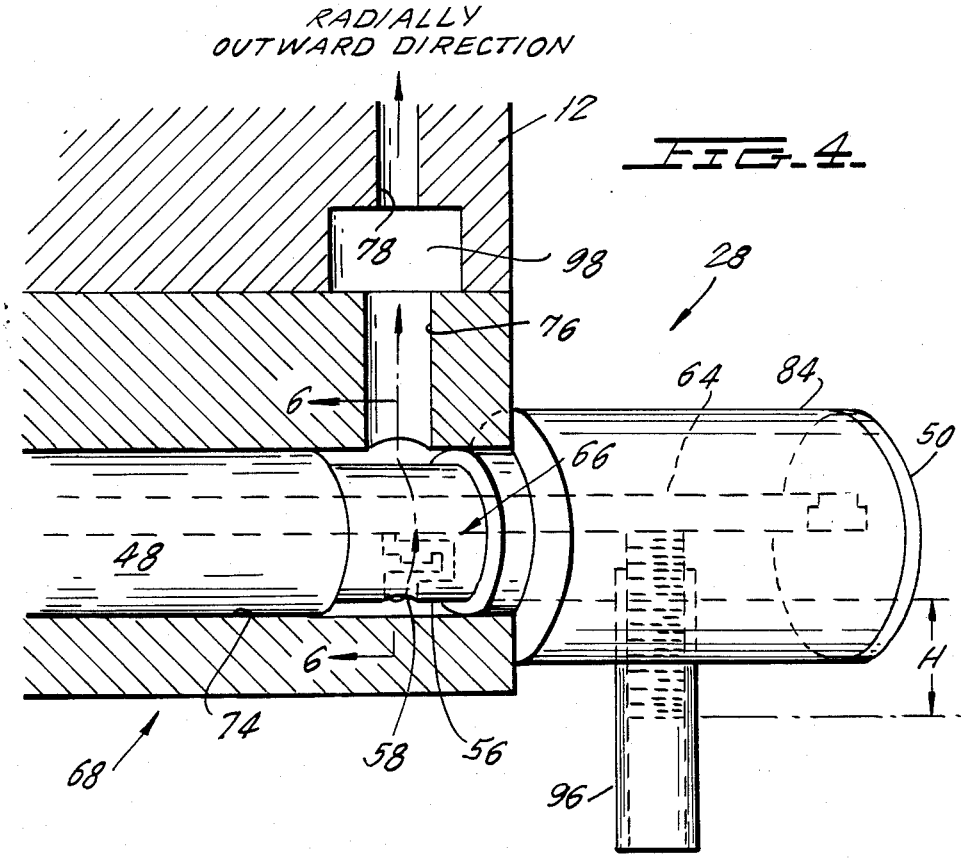
FIG. 4 illustrates the interrelationship between the distribution channel inner member of FIG. 3 and certain coolant channels formed in the distribution channel outer housing of FIG. 2.

As best shown in FIG. 4, a plurality of trap seals 98 are interposed in shank coolant channels 78 (preferably at the bottom thereof) to permit the passage of liquid coolant from distribution channel 28 to coolant channels 78 but prevent the passage of coolant vapor from coolant channel 78 to distribution channel 28. The structure of these coolant channels is described in detail in U.S. Pat. No. 4,244,676.

As best illustrated in FIG. 1, shank coolant channels 78 extend from distribution channel 28 to a plurality of platform coolant channels 30 (only two of which are shown) formed in platform 16 that in turn lead to foil coolant channels 32 formed in the foil 18. The foil coolant channels 32 extend in a generally radial direction throughout the outer perimeter of air foil 18 and serve to cool the foil.

As shown in FIG. 1, the distribution channel 28 has a flattened top 22 which mates with a flattened bottom 62 of the turbine bucket 10 when the bucket and distribution chanel are placed in the dovetail opening formed in rotor disk 20. Both surfaces 62, 22 are machined flat and parallel with the convolutions of the dovetail slot so that the centrifugal force applied to distribution channel 28 when the turbine is rotating ensures parallelism between these surfaces and the dovetail slots.

The detailed structure of distribution channel 28 will now be described with reference to FIGS. 2–10.

Figure 3:
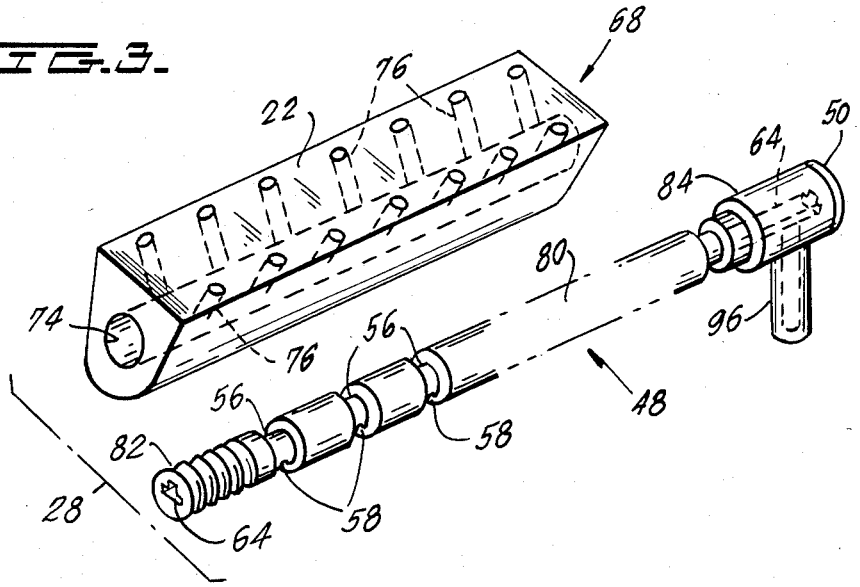
FIG. 3 is an exploded view of a distribution channel forming part of the cooling system of FIG. 1.

As shown in FIG. 3, distribution channel 28 comprises two parts: an outer casing 68, and a cylindrical member 48. Outer casing 68 fits under the bottom most convolution of the dovetail slot in rotor disk 20. A cylindrical bore 74 is formed in outer casing 68 and receives member 48 in interference fit therewith. A plurality of coolant channels 76 are formed in the top of casing 68 and each extends from bore 74 to flattened top 22. Coolant channels 76 are equal in number to the number of platform coolant channels 30 and are each connected to a respective platform coolant channel 30 by one of the shank coolant channels 78.

Member 48 has a hollow cylindrical central section 80, a threaded extension section 82, a coolant supply receiving section 84 and a side cover 50 which may, if desired, be formed integrally with member 48. The outer diameter of central section 80 is substantially identical to the inner diameter of bore 74 to ensure an interference fit when central section 80 is placed in bore 74. The length of central section 80 is equal to the length of bore 74 such that sections 82 and 84 extend beyond opposite ends of outer casing 68.

When distribution channel 28 has been placed in its position within the dovetail slot formed in rotor disk 20 (see FIG. 1), threaded extension section 82 extends through an opening 90 in ring 34. In the preferred embodiment, the external threads on extension section 82 engage a retaining nut 92 which serves to lock a ring 34 to rotor disk 20.

Coolant supply receiving section 84 of member 48 extends out the opposite side of casing 68. Coolant fluid enters a plenum 64 through stand pipe 96 which communicates with passage 94 formed in ring 34.

A plurality of grooves 56 are formed around the outer perimeter of central sction 80 at spaced intervals corresponding to the spacing of coolant channels 76 formed in outer casing 68 such that each groove 56 cooperates with a different shank coolant channel 78. Liquid coolant supplied to supply plenum 64 exits member 48 via individual exit openings 58 formed in each of the grooves 56. A respective flow resistance device 66 (see FIGS. 5–10) is located between supply plenum 64 and each exit opening 58 and meters the flow of liquid coolant into its respective opening 58.

The manner in which liquid coolant is supplied to coolant channels 76 by distribution channel 28 can best be understood with reference to FIG. 4. FIG. 4 depicts the right-hand portion of distribution channel 28 after it has been placed in position within the dovetail slot formed in rotor 20, beneath root portion 12 of bucket 10. As the bucket rotates about the central axis of the turbine, the coolant fluid is forced in a radial outward direction by centrifugal force. As such, the coolant flows through stand pipe 96 into the supply plenum 64 where it collects on the radially outward wall of plenum 64. The coolant distributes throughout the distribution channel 28 and builds up in height to a head 74 until it passes through the flow resistance device 66 and flows through the opening 58 and into the groove 56. The so-metered coolant flows into its associated outer casing coolant channel 76 and thereafter to a corresponding shank coolant channel 78, platform coolant channel 30 and foil coolant channel 32.

Three separate embodiments of flow resistance devices which may be utilized in connection with the present invention are illustrated in FIGS. 5–10. While these structures represent the preferred flow resistance devices, it should be recognized that a large number of different flow resistance devices can be used without departing from the spirit and scope of the present invention as long as such devices meter a liquid coolant into the individual coolant channels 76 in such a manner that the flow of coolant through such devices does not depend upon a stable, uniform water surface for accurate metering.

Referring now to FIG. 5, a first embodiment of a flow resistance device 66 is illustrated. In this embodiment, the flow resistance device 66 comprises a tortuous path 88 comprising a series of bends. In order to operate properly, it is essential that these passages be filled with liquid in order to generate the requisite losses. This is ensured when the liquid coolant flows radially inward against the "G" field, as shown. Head losses at each bend contribute to the total resistance of the passage. Passages of relatively large size are possible. For example, passages having a minimum cross-section dimension of 0.025 inches have been found to operate satisfactorily.

The relationship between flow and pressure drop as a function of the size and shape of constituent bend elements of the tortuous path may be found in the "Handbook of Hydraulic Resistance" authored by I. E. Idel'-Chik. Since the particular size and shape of the tortuous path does not make up part of the present invention, a further discussion of the manner in which these parameters affect flow characteristics will not be set forth herein.

While the tortuous path 88 may be formed in any desired manner, one simple process is to form the path by laminating a plurality of wafer-like plates 70 each of which has been formed with an opening at the location corresponding to the tortuous path 88. These openings may be formed, for example, by using known photoetching technology similar to that used in producing fluidic devices.

The operation of flow resistance device 66, as illustrated in FIG. 5, is as follows. As the buckets 10 are rotated about the axis of rotor disk 20, the artificially generated "G" field causes the liquid coolant to flow through supply plenum 64 pressing against the radially outward wall thereof. The height of the liquid coolant builds up and passes through a "last chance" strainer 72 located adjacent plenum 64. A separate strainer 72 is provided for each flow resistance device 66. The height of the liquid coolant continues to flow through the tortuous path 88 until it flows out the opening 58 into the groove 56 formed in the distribution channel 28. This liquid then flows into the coolant channel 76 and through its associated bucket coolant channel.

In operation, debris which is heavier than the liquid coolant is centrifuged away from strainer 72 to the bottom 54 of plenum 64. As a result, the openings formed in strainer 72 need only be smaller in diameter than the minimum dimension of tortuous path 88. In the preferred embodiment, strainer 72 is a metallic plate having a plurality of openings formed therein.

A second flow resistance device 66 which may be used in connection with the present invention is illustrated in FIG. 6. In this embodiment, an orifice 46 is used to create the desired head losses. While a single orifice 46 is illustrated, a plurality of orifices may be used. As in the embodiment of FIG. 6, the flow resistance device of FIG. 6 includes a strainer 72 adapted to prevent small debris from flowing into, and thereby clogging, orifice 46. Water builds up in standpipe 96 to a water head H (see FIG. 4) radially inward of exit opening 58. In comparative tests, it has been found that bucket channel flow will vary as a function of the square root of the water head H (see FIG. 4) when using an orifice such as that illustrated in FIG. 6. In comparison, the channel flow varies as a function of $H^{5/2}$ using a "V" shaped notched weir such as that described in U.S. Pat. No. 4,244,676. In the illustrated embodiment, orifice 46 is formed as a projection in a cylindrical flow path 58. Other orifices may, however, be used.

A third embodiment of a flow resistance device 66 constructed in accordance with the principles of the present invention is illustrated in FIGS. 7–10. In this embodiment, the flow resistance device takes the form of a plurality of vortex chambers 81, 83, 85 and 87. Liquid coolant located in supply plenum 64 passes through strainer 72 and flows into a first vortex chamber 81 wherein it is agitated in the known manner (see FIGS. 8, 9 and 10). The agitated coolant leaves vortex chamber 81 via a cylindrical opening 79 into a second vortex chamber 83.

Figure 8:
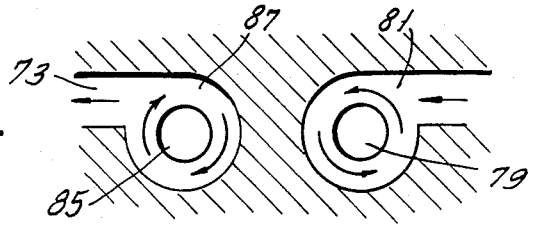
FIG. 8 is a cross-sectional view taken along line 8—8 of FIG. 7.
Figure 9:
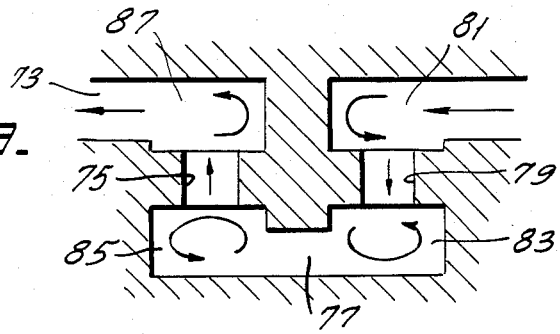
FIG. 9 is a cross-sectional view illustrating internal passages of the flow resistance device of FIG. 7.
Figure 10:
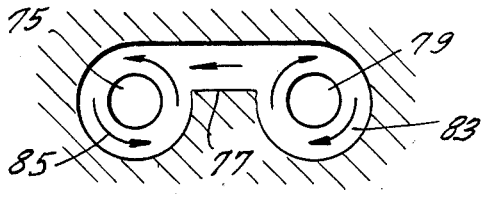
FIG. 10 is a cross-sectional view taken along line 10—10 of FIG. 7.
Figure 2:
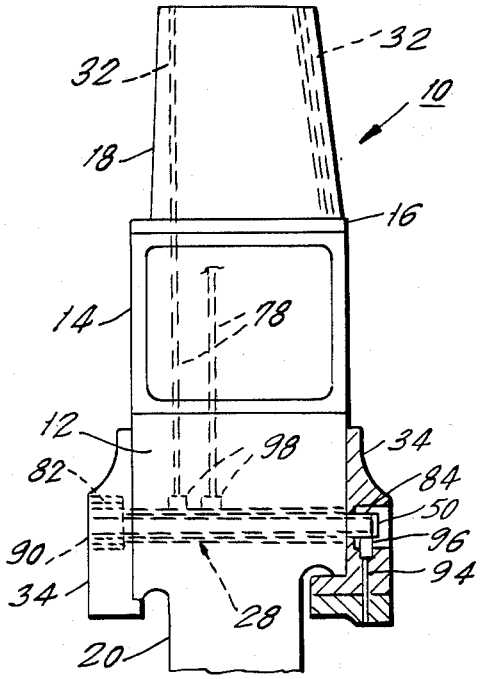
FIG. 2 is a side plan view of a single turbine bucket and distribution channel formed in accordance with the present invention.

As best illustrated in FIGS. 8, 9 and 10, liquid coolant in vortex chamber 83 passes into vortex chamber 85 via a linear passage 77. Liquid coolant leaves vortex chamber 85 via opening 75 and enters fourth vortex chamber 87 (see FIGS. 8, 9 and 10). Finally, the liquid coolant leaves vortex chamber 87 via passage 73 wherein it exits via opening 58 into groove 56.

Having described the structure and operation of the preferred flow resistance devices, the manner in which coolant flows from liquid coolant source through the entire bucket 10 will now be described. The buckets 10 receive a driving force from a hot fluid moving in a direction generally parallel to the axis of rotation of rotor disk 20. The driving force of the hot fluid is transmitted to the shaft about which the rotor disk 20 is mounted via the buckets 10 and rotor disk 20 causing the turbine to rotate about the axis of the shaft. The high rotational velocity of the rotor creates a substantial centrifugal force which urges the liquid coolant through the bucket in a radially outward direction. As the liquid coolant enters coolant supply passage 94, it is forced in a radially outward direction into stand pipe 96 where it is collected in distribution channel 28. When the level of coolant in supply plenum 64 overflows, it passes through the individual flow resistance devices 66 into the respective platform coolant channels 76 and thereafter into the respective shank coolant channels 78. The coolant continues to advance in a generally radial direction to platform and foil coolant channels 30 and 32 to the tip of foil 18.

In the foregoing embodiment, distribution channel 28 is located in the rim of rotor disc 20 below the bucket 10. In U.S. Pat. No. 4,244,676 the manner in which a distribution channel may be located in the platform portion 16 of bucket 10 is illustrated in FIGS. 1–4. A similar arrangement may be used in connection with the present application.

Although several preferred embodiments of this invention have been described, many variations and modifications will now be apparent to those skilled in the art, and it is therefore preferred that the instant invention be limited not by the specific disclosure herein, but only by the appending claims.

What is claimed is:

1. A liquid coolant supply for use in a rotating element wherein rotation of the rotating element produces substantial outward directed radial acceleration, comprising:

a plurality of coolant channels in said rotating element;

a plurality of flow-resistance devices, one per coolant channel;

a single means for feeding a cooling liquid to a radially outward portion of all of said flow-resistance devices;

a path in each of said flow-resistance devices effective for permitting said fluid to flow radially inward to an exit opening;

means for conveying said fluid from said exit opening to its respective coolant channel;

means for permitting a pressure head of said cooling liquid to be formed upstream of said single means for feeding a cooling liquid;

each of said plurality of flow-resistance devices including means for metering a flow therethrough proportional to a function of a said pressure head applied thereto whereby a flow through each of said flow resistance devices to its respective coolant channel is related to said head and a flow resistance thereof and is substantially independent of a flow through others of said flow resistance devices; and wherein said path includes a respective strainer located between said radially outward portion and each of said flow resistance devices.

2. The liquid coolant supply of claim 1, wherein said flow resistance devices each include a tortuous path formed of a plurality of bends.

3. The liquid coolant supply of claim 1, wherein said flow resistance devices each include a flow resistant orifice.

4. The liquid coolant supply of claim 1, wherein said flow resistance devices each include a plurality of vortex flow chambers.

5. The liquid coolant supply of claim 1 wherein said means for permitting a pressure head of said cooling liquid includes a standpipe and a plenum, said cooling liquid being urged into said plenum from said standpipe by a pressure developed said outward-directed radial acceleration.

* * * * *